US007866993B2

(12) United States Patent
Ohsumi

(10) Patent No.: US 7,866,993 B2
(45) Date of Patent: Jan. 11, 2011

(54) CONNECTOR

(75) Inventor: Masami Ohsumi, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 81 days.

(21) Appl. No.: 12/296,866

(22) PCT Filed: May 8, 2007

(86) PCT No.: PCT/US2007/068433

§ 371 (c)(1),
(2), (4) Date: Oct. 10, 2008

(87) PCT Pub. No.: WO2007/134025

PCT Pub. Date: Nov. 22, 2007

(65) Prior Publication Data

US 2009/0137138 A1 May 28, 2009

(30) Foreign Application Priority Data

May 15, 2006 (JP) ..... 2006-135503

(51) Int. Cl.
*H01R 13/44* (2006.01)

(52) U.S. Cl. ..... 439/141; 439/159

(58) Field of Classification Search ..... 439/141, 439/159

See application file for complete search history.

(56) References Cited

U.S. PATENT DOCUMENTS 6,056,572 A 5/2000 Matsumoto et al.
6,135,802 A 10/2000 Nakamura
6,524,134 B2 2/2003 Flickinger et al.
6,832,923 B2 12/2004 Sasame et al.
7,086,880 B2 * 8/2006 Uchida ..... 439/141
2004/0229484 A1 * 11/2004 Uchida ..... 439/137
2006/0270254 A1 * 11/2006 Chiang et al. ..... 439/137
2007/0105446 A1 * 5/2007 Lai et al. ..... 439/630

FOREIGN PATENT DOCUMENTS

JP 16095513 3/2004

* cited by examiner

*Primary Examiner*—Truc T Nguyen
(74) *Attorney, Agent, or Firm*—Johannes P. M. Kusters

(57) ABSTRACT

The present invention provides a connector capable of preventing contacts from being touched by fingers or things through an opening of a connector housing, and of thereby improving connection reliability. A plug connector comprising a connector housing and PCB having contacts contained in the connector housing with a contacting surface exposed at one end and which functions as an interface capable of transmitting electric signal or light signal by being fitted to a receptacle connector to connect respective contacts to each other, characterized in that a shutter is provided as a part of a bottom wall of the connector housing to be freely opened or closed at a position covering the contacts formed in PCB, and that, before fitting of the connector, the shutter is in a closed state, and during and after fitting of the connector, the shutter is in a opened state.

6 Claims, 8 Drawing Sheets

CONNECTOR

TECHNICAL FIELD

The present invention relates to a connector used as an interface for various apparatus constituting a computer system, for example, to be fitted to a counter part connector for respective contacts to be electrically connected to each other so as to transmit electric signal or light signal.

BACKGROUND

In general, a connector as shown in FIG. 9 for being electrically connected to a counter part connector (receptacle connector) that is fixed to a circuit board such as a mother board on server's side has been known. This connector is a plug connector as a transceiver module complying with MSA (Multi Source Agreement) on SFP (Small Form-Factor Pluggable). A connector complying with this specification is capable of transmitting signal at a rate of several Gbps (bits/s), for example at a rate of 2-4 Gbps, to a hard disk or a storage device such as RAID (Redundant Arrays of Independent Disks) or a CD-ROM.

In MSA, specification is provided on mechanical interface part of a system including a plug connector, a receptacle connector and a circuit board on server's side for receiving external signal. With regard to a plug connector, specifications are provided on shape, dimensions, dimensional tolerances and the like, and with regard to a PCB (Printed Circuit Board) contained in the cavity, specification on contact lay-out and the like are provided. With regard to a receptacle connector, specifications are provided on shape, dimensions, and dimensional tolerances as well as contact lay-out corresponding to the contacts of a plug connector are provided. With regard to a circuit board on server's side, specifications on contact lay-out on ASIC side and on BEZEL side are provided. In addition, specification on dimensions of a cage (receptacle) which functions also as a noise shield, and on insertion force and retaining force between connectors electrically connected to each other, are provided.

FIG. 9 is a view showing a plug connector 50 upside down for the sake of convenience. The connector 50 comprises a connector housing 51 and a PCB 55 which is contained in the cavity 58 of the connector housing 51 and has contacts 57 with contacting surface exposed at one end. The connector housing 51 comprises an upper shell and a lower shell 52, 53 formed of electro-conductive material. The lower shell 53, which is positioned on upper side in the Figure for convenience, has an opening 54 on the side to be fitted to, for example, a receptacle connector. PCB 55 comprises an insulating substrate 56 which has specified circuit pattern formed thereon and has contacts 57 with contacting surface exposed to outside and has unshown cable connection section on opposite side to the contacts 57. PCB 55 is contained in the cavity 58 of the connector housing 51 except for the end having the contacts 57.

A receptacle connector 60 shown in FIG. 10 comprises a connector housing 61 having a fitting section 62, and terminals 63, 64 disposed on upper and lower sides of the fitting section 62. The fitting section 62 is formed in the shape of frame adapted to have PCB of the plug connector inserted therein. The terminals 63, 64 are formed by press punching from electro-conductive material in one unit with the connector housing 61 formed by resin molding. The parts of the terminals exposed in the fitting section 62 are contacts 63*a*, 64*a* and are positioned so as to be electrically connected to the contacts formed on the front and rear sides of PCB.

Another example of conventional plug connector of this type is disclosed in U.S. Pat. No. 6,524,134. A plug connector disclosed in this Patent Document has generally same specification as the plug connector shown in FIG. 9 except that it comprises an adapter and a photoelectric conversion element interconnected to an optical connector at the rear end of the connector housing.

SUMMARY

The opening 54 of the above-mentioned plug connector 50 is formed as the space for allowing insertion of the fitting section 62 of the counterpart receptacle connector 60 at the time of fitting of connectors to each other. On the other hand, the opening 54 exposes the contacts of PCB 55. Thus, there is a problem that, before connector fitting, during handling of the plug connector 50 as a single component, fingers or things may inadvertently touch the contacts 57 and may impair conductivity of the contacts 57. In addition, electro-conductive dust or the like may attach to the gap between adjoining contacts 57 arranged at a prescribed pitch as a row, and insulation between adjoining pair of contacts 57 may be destroyed.

Therefore, it is an object of at least one embodiment of the present invention to provide a connector that is capable of preventing fingers or things from inadvertently touching with the contacts through the opening of the connector housing, and improving connection reliability for electric signal or light signal.

In accordance with the invention as claimed in claim 1, there is provided a connector comprising a connector housing and a circuit board which is contained in the connector housing and has contacts with a contacting surface exposed at one end thereof, said connector being fitted to a counterpart connector such that respective contacts are electrically connected to each other, characterized in that said connector comprises a shutter provided as a part of a wall of said connector housing so as to be freely opened or closed at a position covering said contacts which are formed on said circuit board, and that said shutter is in a closed state before a connector fitting and is in an opened state after the connector fitting.

In accordance with the invention as claimed in claim 2, there is provided a connector according to claim 1, wherein said shutter can slide in a connector fitting direction.

In accordance with the invention as claimed in claim 3, there is provided a connector according to claim 2, wherein said shutter is biased by an elastic member in the connector fitting direction.

In accordance with the invention as claimed in claim 4, there is provided a connector according to claim 3, wherein, during the fitting of the connector, a front end of said shutter abuts against a wall of said connector housing so as to exert a force greater than said biasing force of the elastic member to thereby open said shutter.

In accordance with the invention as claimed in claim 5, there is provided a connector according to claim 3 or 4, wherein said elastic member is a compression coil spring at least partly contained in receiving groove which is formed in the wall of said connector housing.

In accordance with the invention as claimed in claim 6, there is provided a connector according to any one of claims 1 to 5, wherein a guide groove of prescribed groove length extending in a sliding direction of said shutter is provided on one of said shutter and said connector housing, and an engaging section engaging with said guide groove is provided on the other of said shutter and said connector housing.

In accordance with the invention, wherein said connector is of specification in accordance with the SFP (Small Form-Factor Pluggable).

In accordance with the invention as claimed in claim 1, since the connector comprises a shutter as a part of the wall of said connector housing provided at a position covering said contacts formed on said circuit board so as to be freely opened or closed, during or after fitting of the connectors, the shutter is in opened state to allow interconnection of contacts of both connectors, and before fitting of the connectors, the shutter is in closed state so that the contacts are protected from external disturbances. Therefore, when handling the connector as a single component before fitting of the connectors, the contacts are prevented from coming inadvertently into contact with fingers or things through the opening of the connector housing, and reliability of connection of electrical signal or light signal can be improved. Further, since a guide groove that is provided on one of the shutter and the connector housing engages with an engaging section that is provided on the other of the shutter and the connector housing, sliding action of the shutter is stabilized. In addition, the stroke of the shutter can be adjusted by the groove length of the guide groove.

In accordance with the invention as claimed in claim 2, since the shutter can slide in the connector fitting direction, a shutter that can be freely opened or closed may be provided on an existing connector without increasing the size of the connector.

In accordance with the invention as claimed in claim 3, since the shutter is biased by an elastic member in the connector fitting direction, the shutter is always in closed state before fitting of the connector and the contacts can be protected from external disturbances.

In accordance with the invention as claimed in claim 4, since the shutter can be opened by the fitting action of the connector, the shutter can be opened easily.

In accordance with the invention as claimed in claim 5, since a compression coil spring as an elastic member is contained in a receiving groove of the connector housing, extending/contracting action of the compression coil spring is ensured by preventing the compression coil spring from buckling (bending) when the compression coil spring is compressed by the fitting action of the connector. Thus, the shutter can be reliably opened or closed.

In accordance with the invention as claimed in claim 6, there is provided a connector which has contacts protected by a shutter and complying with SFP specification, and which is excellent in reliability in connection of electric signal or light signal.

DETAILED DESCRIPTION

Figure 1:
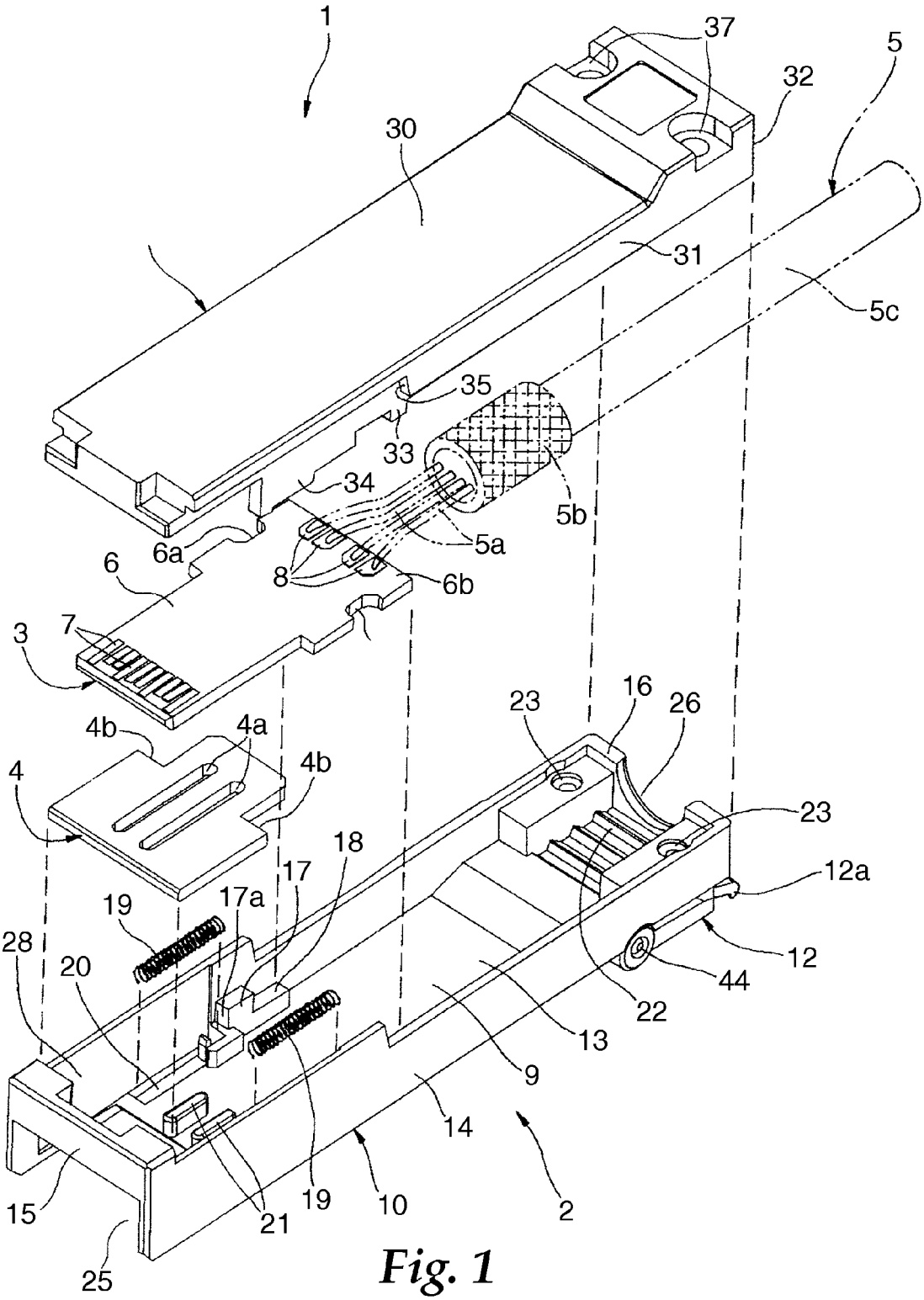
FIG. 1 is an exploded perspective view showing a plug connector according to an embodiment of the present invention.
Figure 2:
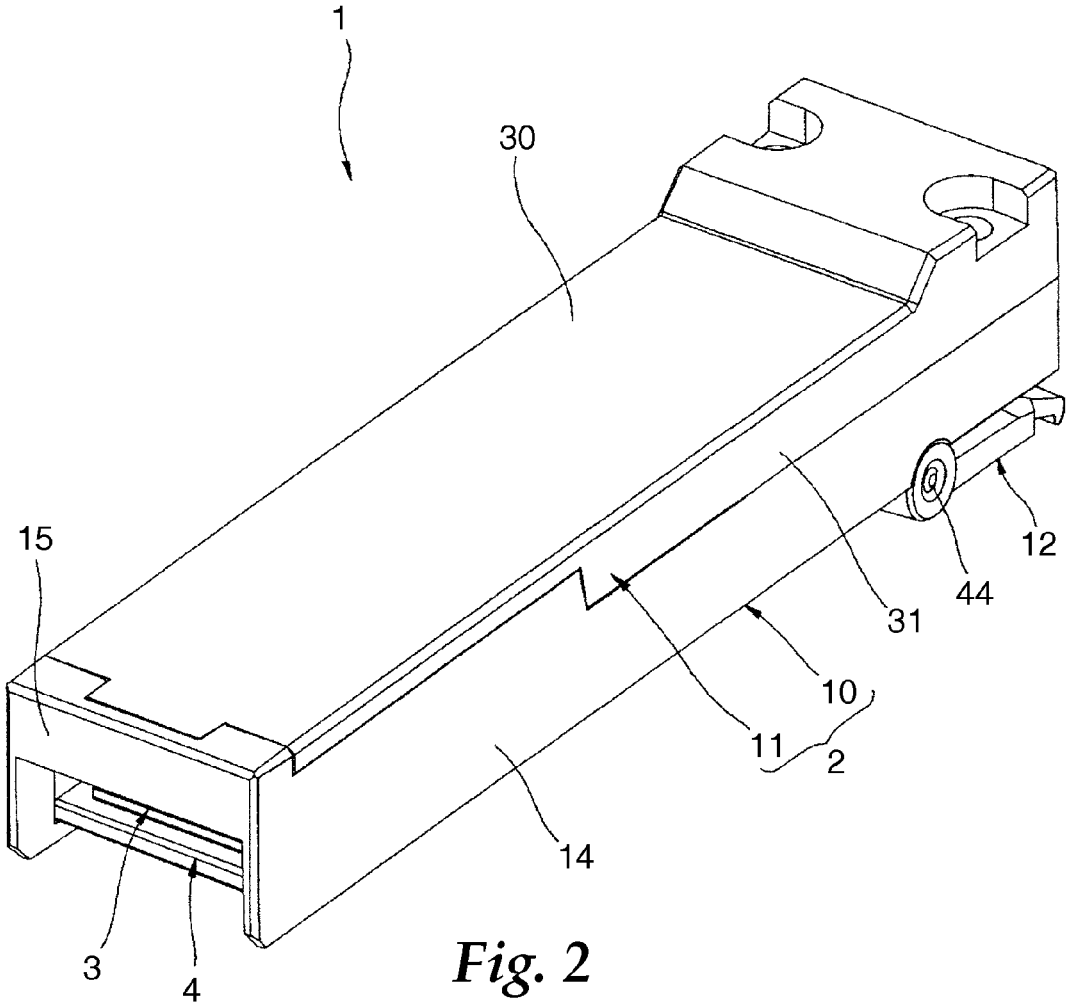
FIG. 2 is a view showing the assembled state of the plug connector shown in FIG. 1.

The present invention will be described in detail below with reference to drawings showing a specific example of an embodiment. In drawings, parts common to various drawings are denoted by same reference numerals or symbols, and duplicate explanation thereof will be omitted. In FIG. 1 or 2, a plug connector (connector) 1 according to the present embodiment comprises a connector housing 2, PCB (circuit board) 3 which is contained in the connector housing 2 and has contacts 7 with contacting surface exposed at one end, a shutter 4 which is provided as a part of the bottom wall (wall) of the connector housing 2 so as to be freely opened or closed at a position covering the contacts 7, and shielded cable 5 which is inserted to the connector housing 2 from the rear end and is connected to a conductor section (pad) 8 at the rear end of PCB 3.

The connector housing 2 is constructed from metal material having high electric conductivity and good moldability, such as zinc, aluminum, or the like, with its wall formed as halved structure of an upper shell 10 and a lower shell 11. The upper and lower shells 10, 11 are molded respectively in shapes corresponding to the counterpart shells 11, 10. When the upper and lower shell are assembled in one unit, a cavity 9 for containing the terminal side of the shielded cable 5 and PCB 3, is formed between the upper and lower shells 10, 11. This cavity 9 is opened and formed at front and rear ends of the connector housing 2, and the fitting to the receptacle connector 45 (FIGS. 6-8) is permitted on the front side, and introduction of the shielded cable 5 into the connector housing 2 is permitted on the rear side.

The lower shell 10 comprises a bottom wall 13, left and right side wall 14 formed upright at both edge of the bottom wall 13, a front wall 15 on the side of connector fitting and a rear wall 16 on the side of cable introduction. Generally at longitudinally middle point of the lower shell 10, at the intersection of the bottom wall 13 and the side wall 14, there is formed a locking protrusion 17 for engaging with an engaging groove **6*a* formed on both sides of PCB 3. The engagement of the engaging groove 6*a* with the locking protrusion 17 limits the movement of PCB 3 in forward/rearward direction. Thus, at the time of fitting connectors, the force exerted to PCB by the receptacle connector 60 (corresponding to connector fitting force) acts on the front side of the engaging surface 17*a* of the locking protrusion 17** to thereby achieve the connector fitting.

The step which is formed adjacent to the locking protrusion 17 so as to extend in rearward direction and which has height smaller than the locking protrusion 17 serves as support 18 for supporting the rear sides **6*b* adjacent to the engaging groove 6*a* of PCB 3. When the upper and lower shells 10, 11 are assembled in one unit, the rear side 6*b* is sandwiched between the support 18 on both sides of the lower shell 10 and the press member 33 of the upper shell 11 which is opposed to the support 18 on both sides. PCB 3 is thus supported by the connector housing 2 in cantilever state with the front side provided with contacts 7** as a free end and the rear end as a fixed end.

Also, at a position on the front side of the locking protrusion 17, at the intersection of the bottom wall 13 and side wall 14 on both sides, there is provided a receiving groove 20 for containing the lower part of the compression coil spring 19 which biases the shutter 4 to be described later in the connector fitting direction. The length of the receiving groove 20 is determined by taking the stroke of the shutter 4 into consideration. The groove width of the receiving groove 20 is selected such that, when the compression coil spring 19 contracts under compressive force, the compression coil spring 19 can contract straight without buckling. The compression coil spring 19 is elastically mounted in the receiving groove 20 with one end abutting to the rear end of the receiving groove 20 and with the other end abutting to the step 4*b* of the shutter 4.

On the inner surface of the bottom wall 13, at a position corresponding to the shutter 4, between the receiving grooves 20 on both sides, there are provided two protruding engaging sections 21 for guiding the sliding of the shutter 4. The shutter 4 is formed with guide grooves 4*a* for engaging with the engaging sections 21. The groove length of the guide groove 4*a* is selected in correspondence to the stroke of the shutter 4. By the engagement of the engaging sections 21 with the guide grooves 4*a*, the shutter 4 is guided and slides in the connector fitting direction.

Figure 3:
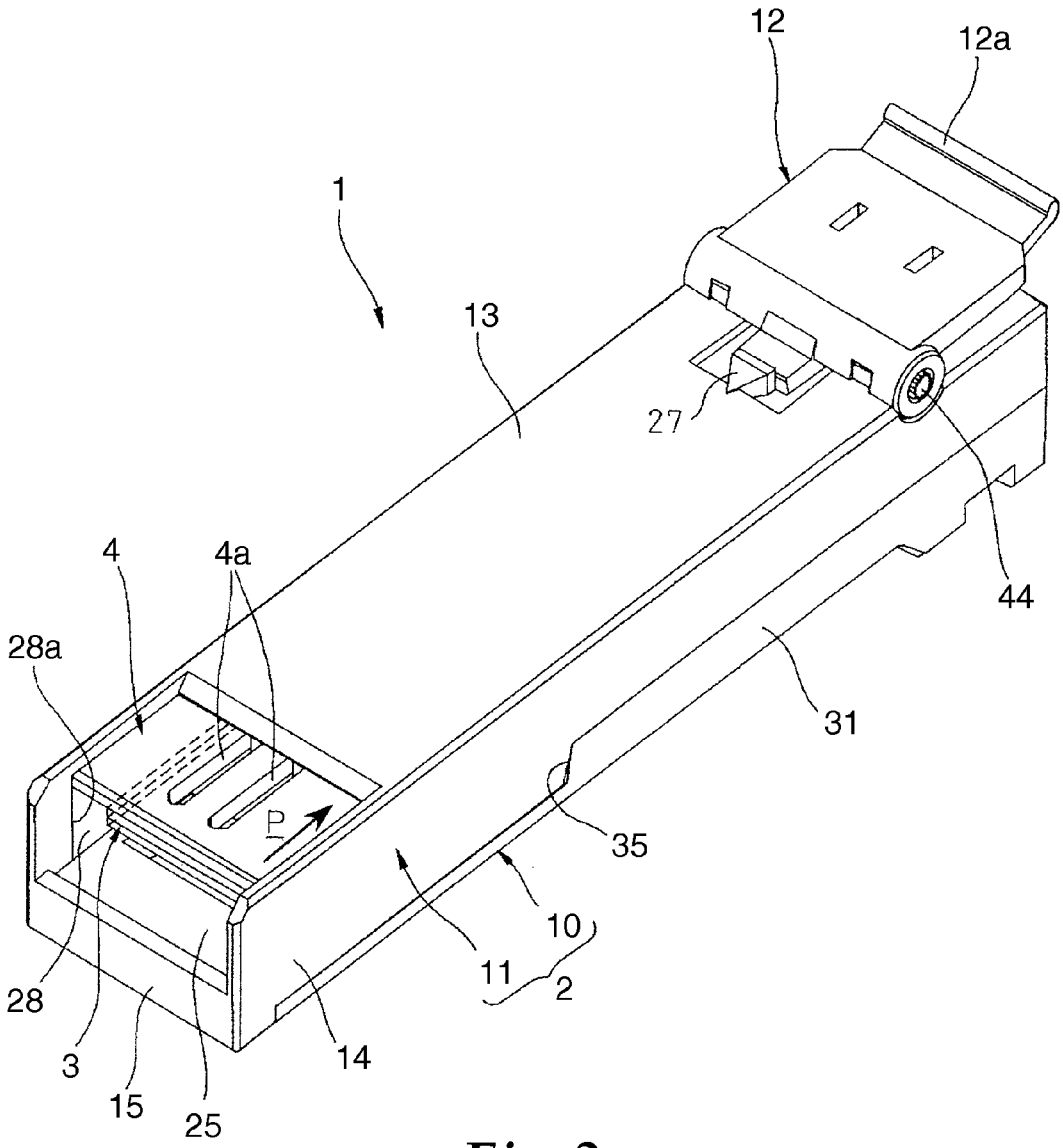
FIG. 3 is a view showing upside down the assembled state of the plug connector shown in FIG. 2.

At the intersection of the front side of the bottom wall 13 with the lower side of the front wall 15, an opening 25 is formed so as to allow for fitting to the receptacle connector 45 (see FIG. 3). The opening 25 consists of a rectangular bottom wall opening formed in the bottom wall 13 and a rectangular front wall opening formed in the front wall 15. Opening width of the bottom wall opening is equal to the distance between the two opposed side walls 14 (inside dimension), and is selected so as to be larger than the width of the frame-like fitting section 47 of the receptacle connector 45 shown in FIG. 6 or the like. Opening length of the bottom wall opening is selected so as to be comparable to or larger than the length of the receptacle connector 45. Thus, the contacts 7 formed so as to face outward on the board surface of PCB 3 are exposed completely through the bottom wall opening. The front wall opening is formed such that the opening width is equal to the opening width of the bottom wall opening, and the opening height of the front wall opening is comparable to or higher than the height of the receptacle connector 45. Thus, the receptacle connector 45 is guided by the inner surface of both side walls 14 which defines the bottom wall opening, and is fitted into the connector housing 2 through the end of the front wall opening, and simultaneously with the fitting, PCB 3 is slidingly inserted between the upper and the lower walls of the receptacle connector 45, with the contacts 7 on the front and back surfaces of PCB 3 coming into contact with the contacts 48*a*, 49*a* of the receptacle connector 45, respectively, to thereby complete the connection of two connectors 1, 45. After the connection of the connectors is completed, the receptacle connector 45 is received and contained in the connector housing 2.

On the rear side of the lower shell 10, a cable sandwiching section 22 is formed for sandwiching the terminal side of the shielded cable 5 from above and from below in cooperation with the upper shell 11. The cable sandwiching section 22 is formed such that the surface coming into contact with the external surface of the shielded cable 5 is in the shape of saw teeth as seen in the direction perpendicular to the longitudinal direction of the cable 5, so that, when the shielded cable 5 is sandwiched therebetween, the saw teeth bite into the external surface of the cable to thereby effectively prevent the shielded cable 5 from being shifted in the longitudinal direction. Thus, inadvertent pulling force exerted to the cable is prevented from being transmitted to the soldered portion which is the connection of the shielded cable 5 and PCB 3, and disconnection of the shielded cable from PCB 3 can be thus avoided. On the rear side of the lower shell 10, in the thick portions on both sides of the cable sandwiching section 22, at a position in communication with an insertion hole 37 in the upper shell 10, a screw hole 23 is formed for threaded engagement with an unshown screw to be tightened to assemble the upper and the lower shells 10, 11 in one unit.

On the rear wall 16 of the lower shell 10, a semi-circular notch 26 is formed for introducing the shielded cable 5 into the connector housing 2. A similar semi-circular notch (not shown) is formed on the rear wall 32 of the upper shell 11. When the upper and the lower shells are assembled into one unit, the respective semi-circular notches 26 are joined to form a generally circular hole. The diameter of the hole thus formed is of a dimension comparable to the outer diameter of the shielded cable 5. If there is a gap between the hole and the shielded cable 3, a ring-shape rubber can be used to eliminate the gap. By eliminating the gap between the hole and the shielded cable 5, flexure of the shielded cable which has been permanently deformed in bending in radial direction of the hole due to elastic restoring force can be prevented so that the soldered portion as the connection of the shielded cable 5 to PCB 3 is prevented from being affected by unnecessary force.

Also, the lower shell 10 is provided with a lock releasing member 12 used to release the fitting of two connectors 1, 60 (see FIG. 3). The lock releasing member 12 is pivotally mounted with one end supported via a pivot axis on the bottom wall 13. The other end of the lock releasing member 12 functions as a press section 12*a* to be pressed by a finger or the like. In the fitting state of two connectors 1, 60, that is, when a locking claw 27 of the plug connector 1 engages with a locking hole of an unshown cage and the plug connector 1 is thus fixed to the cage, the press section 12*a* of the lock releasing member 12 may be pressed to raise the front end of the lock releasing member 12 by the principle of lever action, and this elastically deforms the cage wall so as to release the engagement of locking claw 27 with the locking hole.

Next, the upper shell 11 is formed in a shape corresponding to the lower shell 10, and comprises a top wall 30 opposed to the bottom wall 13 of the lower shell 10, side walls 31 intersecting with the top wall 30 and engaging with the side walls 14 of the lower shell 10, and a rear wall 32. The top wall 30 is formed in a flat shape. On the inner surface of the top wall 30, there are provided a press section 33 which cooperates with the lower shell 10 to sandwich PCB 3 in vertical direction, and a cover section 34 which is positioned above the compression coil spring 19, and defines, together with the receiving groove 20, the receiving chamber of the compression coil spring 19 in order to prevent the compression coil spring 19 from inadvertently coming out of the receiving groove 20. The side walls 31 have steps 35 at positions corresponding to the side walls 14 of the lower shell 10 in order to facilitate positioning of the upper and the lower shells 10, 11.

PCB 3 comprises an insulating substrate 6 formed of organic material such as epoxy resin, having signal lines and grounding lines integrally formed as wiring conductors. As epoxy resin for constructing the insulating substrate 6, a paper based epoxy resin, glass fiber based epoxy resin, or glass fiber/paper composite material based epoxy resin, etc. may be applied. As wiring conductor composing a contact pattern complying with SFP, an electro-conductive metal foil of a few tens μm in thickness, for example, copper foil, etc., may be applied. On the front side of PCB 3, the contacts 7 are formed as exposed on both front surface and back surface. The contacts 7 formed facing outward on only one surface are positioned in opposition to the shutter 4 to be described later, and is protected by the shutter 4 from interference with fingers or things. On the rear side of PCB 3, there are formed conductor section 8 to be soldered to core wires of the shielded cable 5 after the insulating cover is stripped off. The conductor section 8 and the contacts 7 are electrically connected to each other via unshown wiring conductor formed on the insulating substrate 6.

Figure 4:
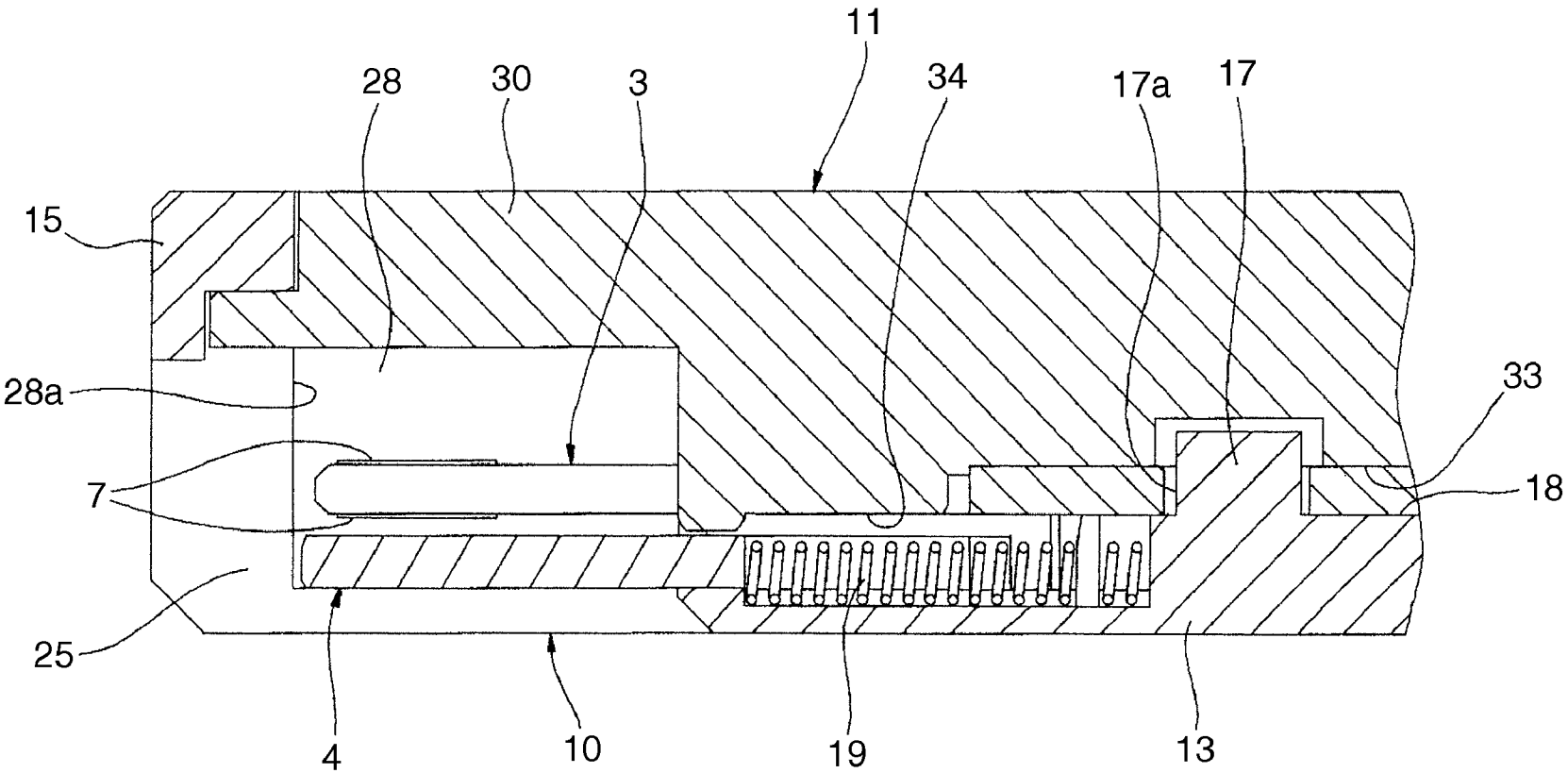
FIG. 4 is a longitudinal sectional view showing the internal structure of the plug connector.
Figure 5:
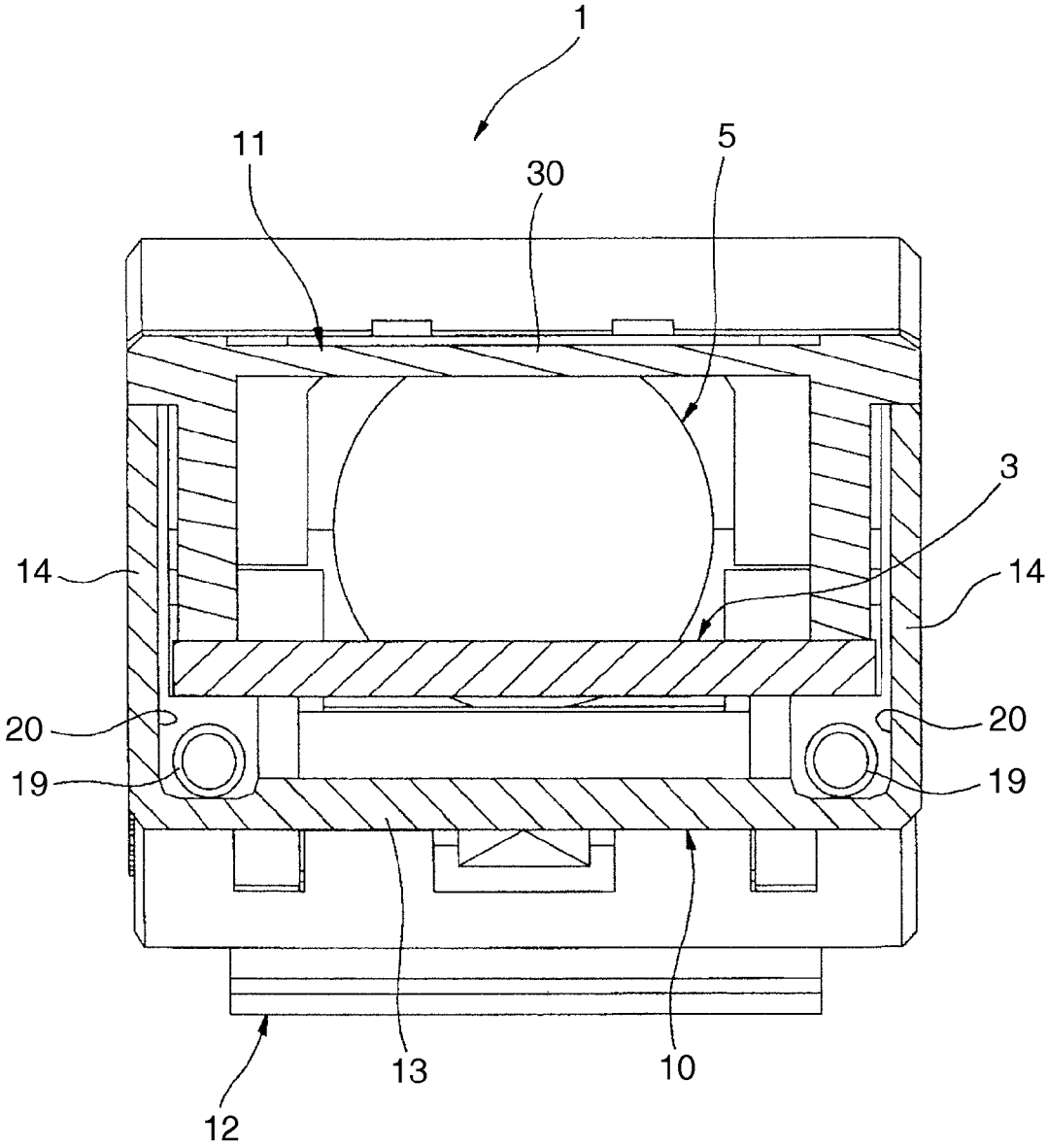
FIG. 5 is a transverse sectional view showing the internal structure of the same plug connector.

The shutter 4 of the present embodiment is, as an example, a resin molding in plate-like shape formed of PBT (polybutylene terephthalate), and is mounted between PCB 3 and the lower shell 10 in a state biased in forward direction (connector fitting direction) by the compression coil spring 19. The shutter 4 has two guide grooves 4*a* in the center portion for engaging with the engaging section 21 of the lower shell 10. The groove length of the guide groove 4*a* defines the slide stroke of the shutter 4. That is, the shutter 4 is limited in its forward movement by the front end corner abutting against a locking surface 28*a* of a thin walled section 28 formed on the inner surface of the sidewall of the lower shell 10 (FIG. 3 or 4), and in its rearward movement by the front end of the guide groove 4*a* abutting against the front end of the engaging section 21.

Figure 7:
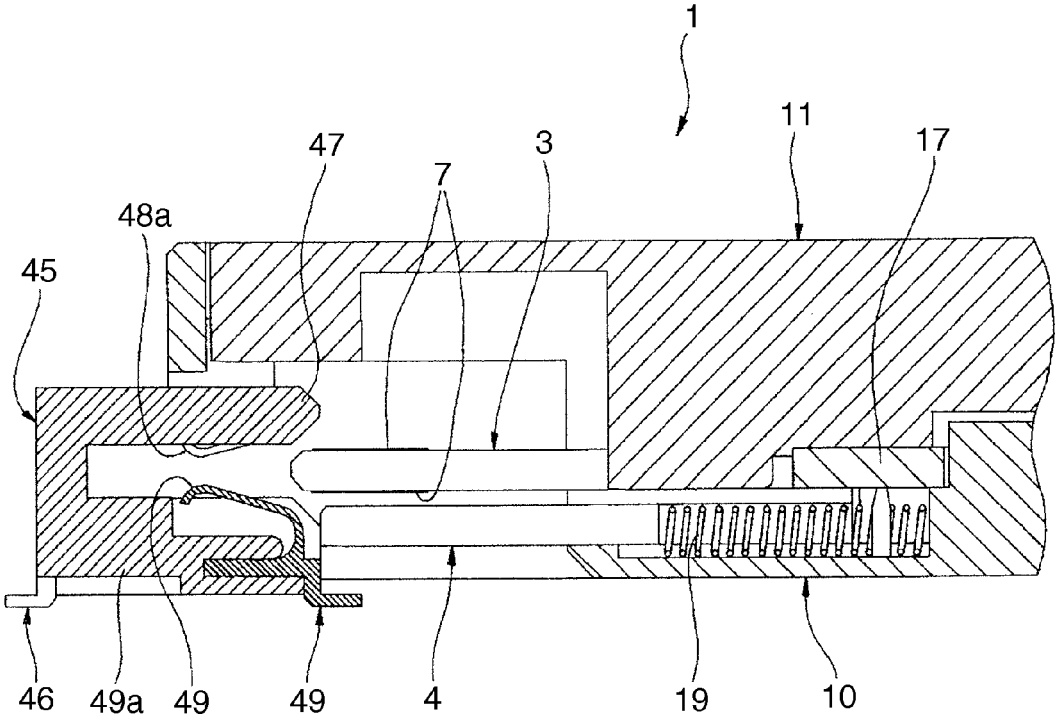
FIG. 7 is a sectional view showing the same plug connector and receptacle connector during fitting.
Figure 8:
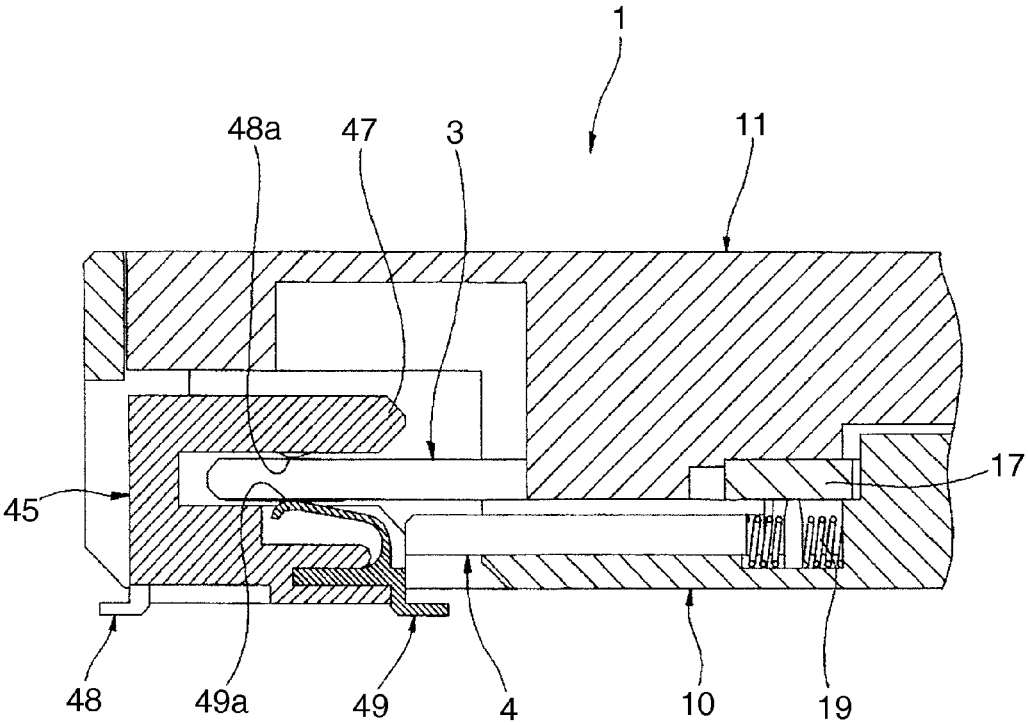
FIG. 8 is a sectional view showing the same plug connector and receptacle connector after fitting.
Figure 9:
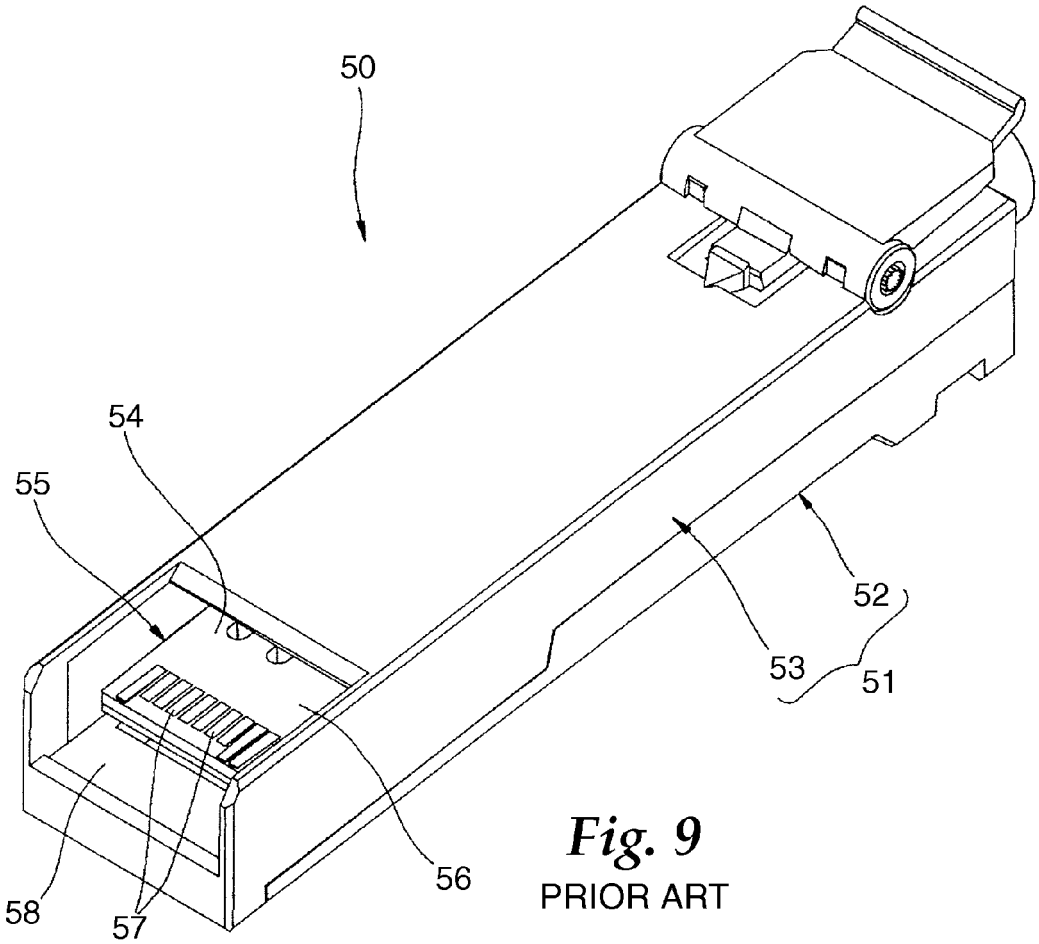
Fig. 9 PRIOR ART
FIG. 9 is a perspective view showing an example of conventional plug connector.
Figure 10:
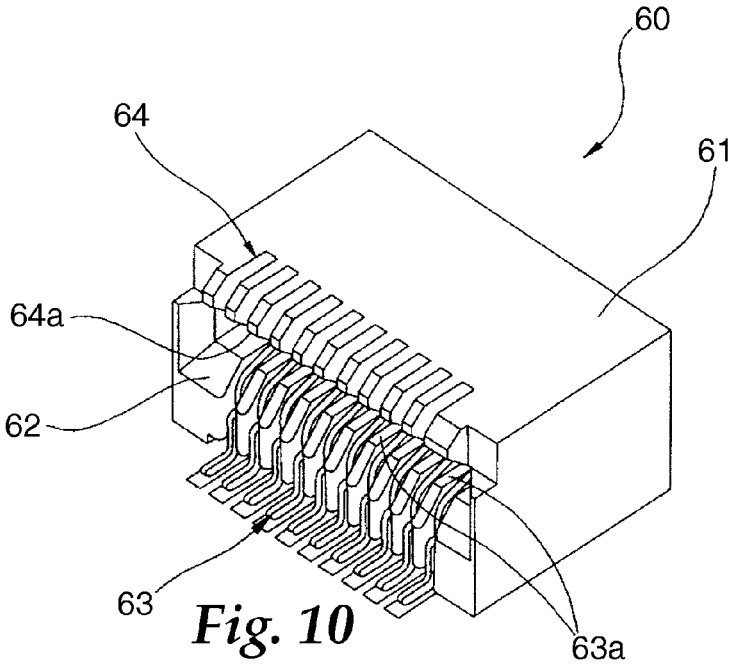
Fig. 10 PRIOR ART
FIG. 10 is a perspective view showing an example of counterpart receptacle connector to be fitted to the plug connector.

When the plug connector 1 and the receptacle connector 45 are being fitted to each other, the shutter 4 is opened by the front end of the shutter 4 abutting against the front end of the frame-like fitting section 47 of the receptacle connector 45 (FIG. 7), and fitting proceeds further so that the exposed contacts 7 of PCB 3 are electrically interconnected to the contacts 48*a*, 49*a* of the receptacle connector 45 (FIG. 8). Thus, before fitting of two connectors 1, 45, the shutter 4 is always in closed state (FIG. 6), and the contacts 7 of PCB 3 are protected from coming into contact with exterior.

Figure 6:
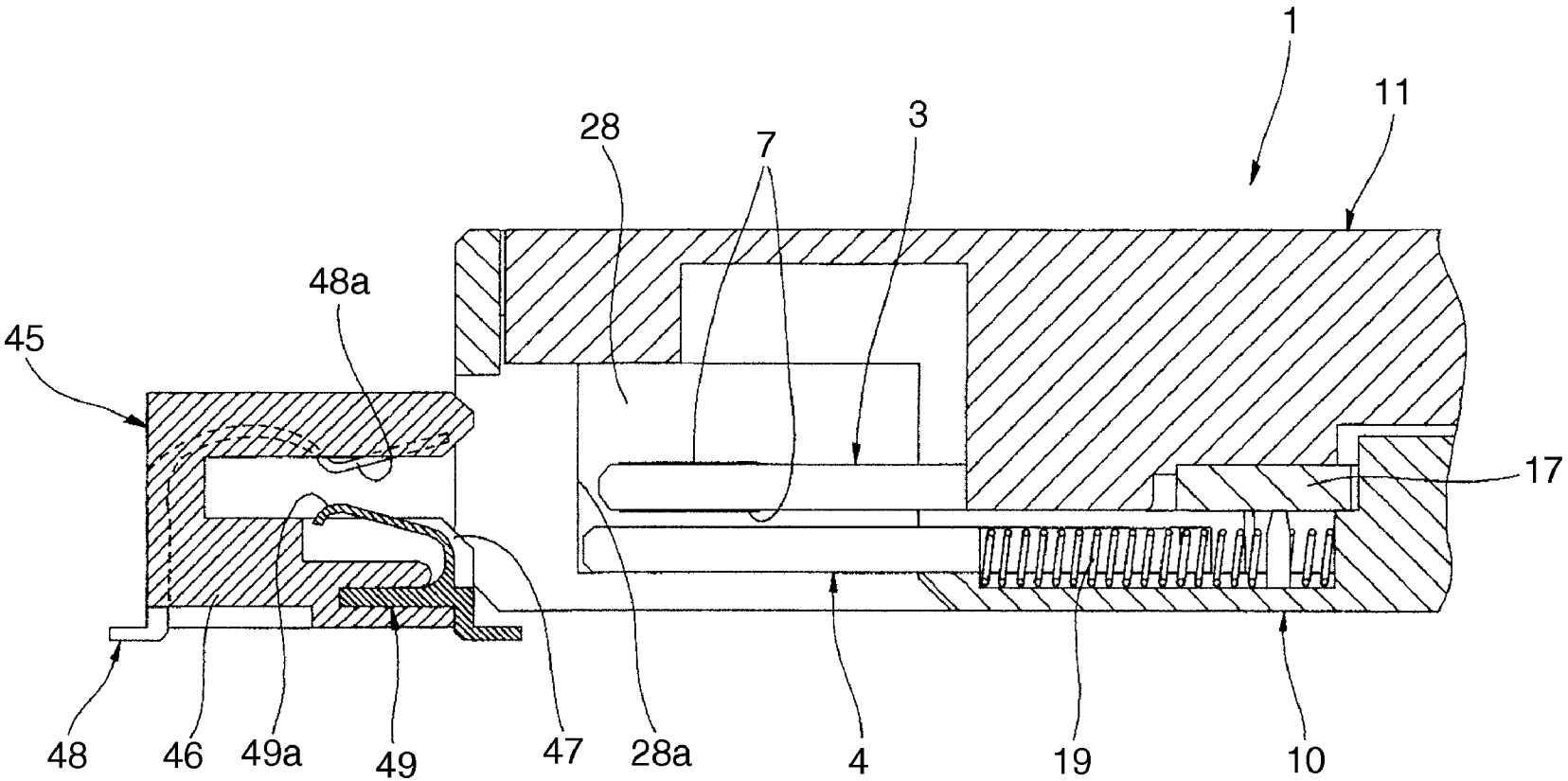
FIG. 6 is a sectional view showing the plug connector and receptacle connector before fitting.

As shown in FIGS. 6-8, the receptacle connector 45 comprises a connector housing 46 having a fitting section 47, and terminals 48, 49 disposed above and below the fitting section 47. The frame-like fitting section 47 is adapted to receive PCB of the plug connector inserted therein. The terminals 48, 49 are formed by press punching of electro-conductive material, and integrated as one unit with the connector housing 46 formed by resin molding. The contacts 48*a*, 48*b* are exposed inside the fitting section 47 and disposed so as to be electrically connected to the contacts 7 formed on front and back surfaces of PCB 3.

In order to fit the plug connector 1 to the receptacle connector 45, the plug connector 1 is first opposed to the receptacle connector 45, as shown in FIG. 6. At this stage, the shutter 4 is in closed state, and the contacts 7 of the plug connector 1 are protected by the shutter 4. Then, as shown in FIG. 7, when the plug connector 1 is advanced, the front end of the shutter 4 abuts against the front end of the fitting section 47 of the receptacle connector 45, and the shutter 4 is moved rearward against the spring force of the compressible coil spring 19. When the plug connector 1 is further advanced, as shown in FIG. 8, the shutter 4 slides as plug connector 1 is advanced, and PCB 3 is inserted into the inside of the connector fitting section 47 of the receptacle connector 45. The contacts 7 of PCB 3 are electrically connected to the contacts 48*a*, 49*a* under elastic restoring force of the terminals 48, 49 flexed outward by the inserted PCB 3. When the plug connector 1 is removed from the receptacle connector 45, the shutter 4 is closed again by elastic restoring force of the compression coil spring 19, and the contacts 7 of PCB 3 are thereby protected.

The shielded cable 5 to be connected to the plug connector 1 of the present embodiment is, as shown in FIG. 1, is a bundle of multiple signal cables 5*a* with outer covering 5*c* having braided wire 5*b*. Each signal cable 5*a* is composed, for example, of a core wire of conductor and inner covering surrounding the core wire. As material of the outer covering, vinyl chloride resin or polyethylene resin may be applied. The terminal end of the shielded cable is formed by stripping the outer covering 5*c* for a prescribed length to expose the braided wire 5*b*, and then removing the inner covering of the signal cable 5*a* to expose the core wire for a prescribed length.

As has been described above, the core wire is soldered to the conductor section 8 formed on the rear side of PCB 3 to be thereby electrically connected to the conductor section 8. Together with PCB 3, the terminals of the shielded cables 5 are introduced into the connector housing 2, and the braided wire 5*b* is folded back outward in U-like turn so as not to come into contact with the core wire, and together with the outer covering 5*c*, is sandwiched between the cable connecting sections 22 of the upper and the lower shell 10, 11. The braided wire 5*b* is thereby electrically connected to the connector housing 2, and signal cables 5*a* in the connector housing 2 is shielded from external disturbance. In this manner, the plug connector 1 acts also as a shielded connector which is shielded from external noise and which improves the reliability of signal transmission.

As has been described above, in the plug connector 1 according to the present embodiment, the shutter 4 is provided as a part of the wall of the connector housing 2 so as to be freely opened or closed at a position covering the contacts 7 of PCB 3, so that, in the opened state of the shutter 4, fitting of connectors is possible in the same manner as with a conventional plug connector, and in the closed state of the shutter 4, the contacts 7 are protected from external disturbances. Therefore, while handling the plug connector 1 as a single component before fitting of connectors, it is possible to prevent the contacts 7 from being touched inadvertently by fingers or things through the opening 25 of the connector housing 2. Since the shutter 4 can freely slide in the connector fitting direction and is biased by the compression coil spring 19, the shutter 4 can be opened in the connector fitting operation without being conscious of its existence.

The present invention is not limited to the above-described embodiment, but can be implemented in various other modes. For example, although the electric signal passing through the signal cable 5*a* is transmitted to server's side via the plug connector 1 and the receptacle connector 60 in the above-described embodiment, it is also possible as with conventional plug connector to provide an adaptor on the rear end side of the plug connector so as to permit an optical connector to be connected, and by using a photoelectric conversion element to convert light coming from an optical fiber into electric signal, to transmit the electric signal to server's side.

Although, in the above-described embodiment, the guide groove 4*a* is formed on the shutter 4 and the protruding engaging section 21 for engaging with the guide groove 4*a* is provided on the bottom wall 13 of the lower shell 10, it is also possible to provide a protruding engaging section 21 on the shutter 4 and to provide a guide groove on the bottom wall 13.

The invention claimed is:

1. A connector comprising a connector housing and a circuit board which is contained in the connector housing and has contacts with a contacting surface exposed at one end thereof, said connector being fitted to a counterpart connector such that respective contacts are electrically connected to each other, characterized in that said connector comprises a shutter provided as a part of a wall of said connector housing so as to be freely opened or closed at a position covering said contacts which are formed on said circuit board, and that said shutter is in a closed state before a connector fitting and is in an opened state after the connector fitting, wherein a guide groove of prescribed groove length extending in a sliding direction of said shutter is provided on one of said shutter and said connector housing, and an engaging section for engaging with said guide groove is provided on the other of said shutter and said connector housing.

2. A connector according to claim 1, wherein said shutter slides in a connector fitting direction.

3. A connector according to claim 1, wherein said connector is of a specification complying with the SFP (Small Form-Factor Pluggable).

4. A connector according to claim 2, wherein said shutter is biased by an elastic member in the connector fitting direction.

5. A connector according to claim 4, wherein, during the connector fitting, a front end of said shutter abuts against a wall of said counterpart connector such that a force greater than the biasing force of said elastic member is exerted to said shutter so as to open said shutter.

6. A connector according to claim 4, wherein said elastic member is a compression coil spring, which is at least partly contained in a receiving groove formed in the wall of said connector housing.

* * * * *